United States Patent [19]

Andress et al.

[11] 3,942,804

[45] Mar. 9, 1976

[54] TURBOMACHINE SEAL

[75] Inventors: Otto G. Andress, Burnt Hills; Joseph W. Fischetti, Ballston Lake; Anthony J. Renzi; Francis D. Ryan, both of Schenectady, all of N.Y.

[73] Assignee: General Electric Co., Schenectady, N.Y.

[22] Filed: Nov. 18, 1974

[21] Appl. No.: 524,755

[52] U.S. Cl. ..... 277/58; 415/170 R

[51] Int. Cl.[2] ..... F16J 15/38; F16J 15/48

[58] Field of Search ..... 277/58–62, 277/237; 415/170 R, 172

[56] References Cited

UNITED STATES PATENTS

| | | | |
|---|---|---|---|
| 1,982,729 | 12/1934 | Eberhard | 277/58 |
| 3,360,274 | 12/1967 | Grant | 277/58 |
| 3,396,975 | 8/1968 | Otto | 277/58 |
| 3,791,657 | 2/1974 | Bilski | 277/58 |
| 3,801,111 | 4/1974 | Messenger | 277/58 |

FOREIGN PATENTS OR APPLICATIONS

| | | | |
|---|---|---|---|
| 607,091 | 8/1948 | United Kingdom | 277/58 |
| 578,660 | 6/1959 | Canada | 277/58 |

*Primary Examiner*—Robert I. Smith
*Attorney, Agent, or Firm*—John F. Ahern; James W. Mitchell

[57] ABSTRACT

In a turbomachine of the type having several sections wherein each section includes a separate hood or casing having a rotor portion therein supported by bearings at each end of the stage or hood, there is provided a stationary to stationary annular seal between adjacent hood ends. The seal comprises an annular wrapper spaced radially outwardly from the turbomachine rotor and a first annular sealing element extending radially inwardly and terminating at a free end at the annular wrapper outer surface in a sliding interference fit. The annular wrapper is attached to one adjacent hood end whereas the first sealing element is attached to the other adjacent hood end and the seal construction accommodates differential thermal movement of the turbomachine stage hoods.

9 Claims, 3 Drawing Figures

TURBOMACHINE SEAL

BACKGROUND OF THE INVENTION

This invention relates, in general, to turbomachinery; and, in particular, this invention relates to a stationary to stationary seal between adjacent turbomachine sections.

A large turbomachine may comprise several axially aligned sections including a dynamoelectric machine or generator all connected in tandem by a common rotor shaft. Each section includes a rotor portion which is supported by a pair of bearings, one at each end of each stage. The rotor portions are coupled to adjacent rotor portions to form the single common rotor. Each bearing is supplied with high pressure oil for lubrication and cooling after which the oil is drained from the turbomachine section. In order to prevent oil from leaking out of the turbomachine stage and also to prevent air and dirt from entering the oil supply, it is customary to provide shaft seals for the rotor. A shaft seal is an annulus which extends radially inwardly from the hood or casing and terminates in a clearance fit closely adjacent the rotor. The free end of the annulus is provided with packing teeth and the clearance may be on the order of a few mils.

Occasionally a packing rub may occur whereby the rotor contacts the surrounding packing teeth or shaft seal. Such an occurrence may cause damage to the rotor and/or damage to the packing teeth and shaft seal. If the effectiveness of the shaft seal is diminished, oil may leak from the turbomachine. Another consequence of diminished seal effectiveness is the ingress of air and dirt into the turbomachine oil supply. If air enters the oil supply frothing may occur. If dirt or lint enters the oil supply a bearing may be damaged, and/or valve clogging and oil passage clogging may result.

Another factor in the design of shaft seals is the relative movement of turbomachine casings or hoods due to thermal differences.

It is therefore one object of the present invention to provide a turbomachine seal which is not subject to rotor contact or packing rub.

It is another object of the present invention to provide a turbomachine seal which may accommodate relative thermal movement of adjacent turbomachine sections.

A further object of the present invention is to provide an improved turbomachine seal which may be easily assembled between adjacent turbomachine sections.

Still another object of the present invention is to provide an improved turbomachine oil seal which is based on an interference fit between sealing elements rather than a clearance fit.

Another object of the present invention is to provide a stationary to stationary oil seal rather than a stationary to rotating oil seal hereinafter described.

The present invention relates to an oil seal positioned between adjacent turbomachine sections. An annular, axially extending wrapper is attached to one adjacent turbomachine section hood. The wrapper surrounds the turbomachine rotor but is spaced radially outwardly therefrom so as to obviate the occurrence of a shaft rub. An annular first sealing element is attached to another adjacent turbomachine section hood and extends radially inwardly towards the turbomachine rotor terminating at the wrapper outer surface in an interference fit. Moreover, appropriate oil deflectors are provided axially adjacent the ends of the wrapper with the wrapper included therebetween.

The novel features believed characteristic of the present invention are set forth in the appended claims. The invention itself, however, together with further objects and advantages thereof, may best be understood with reference to the following description, taken in connection with the appended drawings.

DETAILED DESCRIPTION OF THE INVENTION

Figure 1:
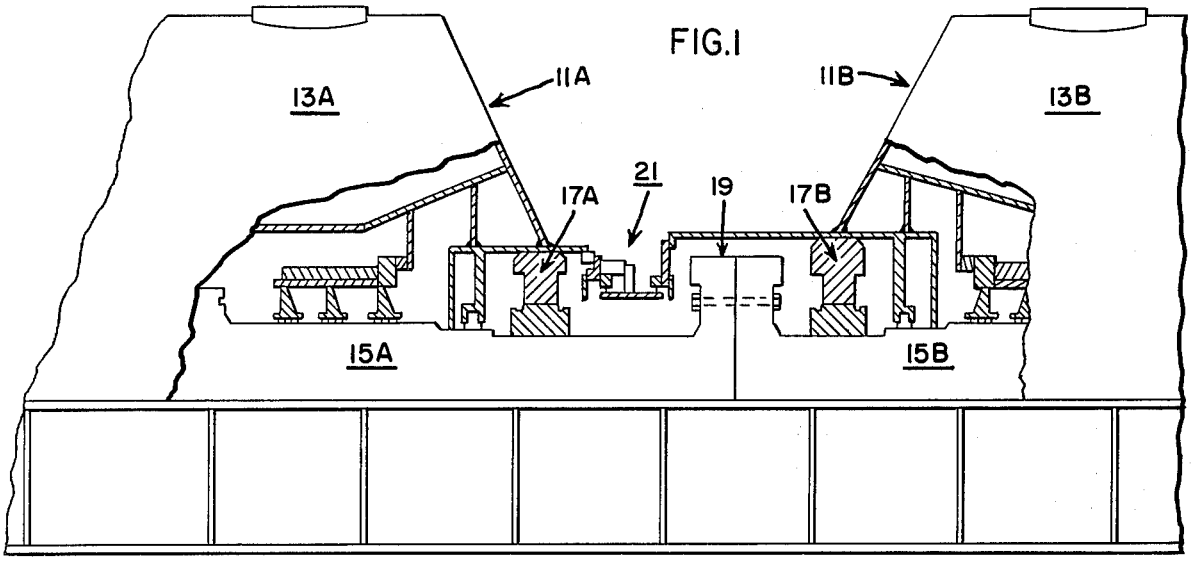
FIG. 1 is a partially cutaway cross section elevation of a pair of adjacent turbomachine section ends with the present invention embodied therein.

Referring to the drawings and particularly referring to FIG. 1, a pair of adjacent turbomachine sections 11A and 11B each comprises a hood or casing 13A and 13B respectively, having rotor portions 15A and 15B rotatable therein. At each end of a hood or section, there is a bearing 17A and 17B respectively, for supporting each rotor portion (only two adjacent end bearings being shown). Adjacent ends of the rotor portions are interconnected at a coupling 19. The present invention is directed to a sealing means 21 which is shown in greater detail in FIG. 3.

Figure 2:
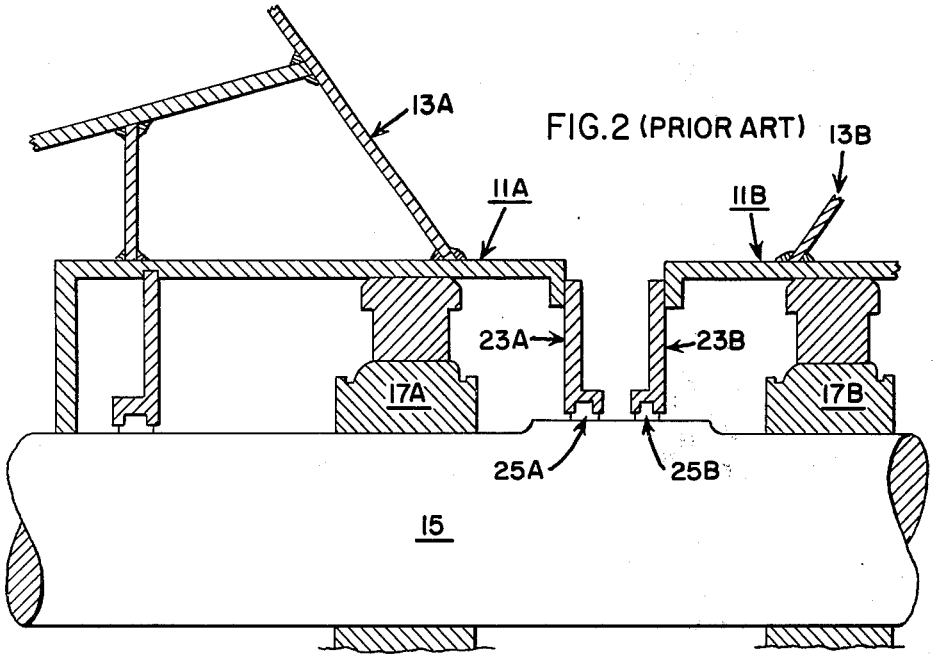
FIG.2 (PRIOR ART)
FIG. 2 is an enlarged cross section view of a prior art oil seal arrangement.

FIG. 2 is illustrative of the prior art. A rotor 15 is rotatably supported by bearings 17A and 17B, the coupling not shown. Each bearing is adjacent one end of a respective turbomachine section 11A and 11B including hood structures 13A and 13B. Each of the bearings is connected to a high pressure oil supply (not shown) which passes oil through the bearing and into the turbomachine hood or casing from which it drains back into a reservoir. Oil is prevented from leaking in the axial direction by means of annular shaft seals 23A and 23B. These shaft seals may be defined as stationary to rotating seals since the stationary seal is cooperatively associated with the rotating rotor shaft. Each of the shaft seals include packing teeth 25A and 25B at their respective free ends. The free ends of the packing teeth are within a few mils radial distance or clearance from the rotor surface. Hence the seal is a stationary to rotating clearance seal. If a packing rub occurs either the rotor and/or the annular seal may be damaged. If seal damage occurs, oil may leak from between adjacent casings or hoods. Moreover, air may leak into the turbomachine section hood causing frothing of the oil supply. A further consequence of seal damage may be dirt or lint contamination of the oil supply leading to valve and/or oil line clogging within the turbomachine and possible bearing damage.

Figure 3:
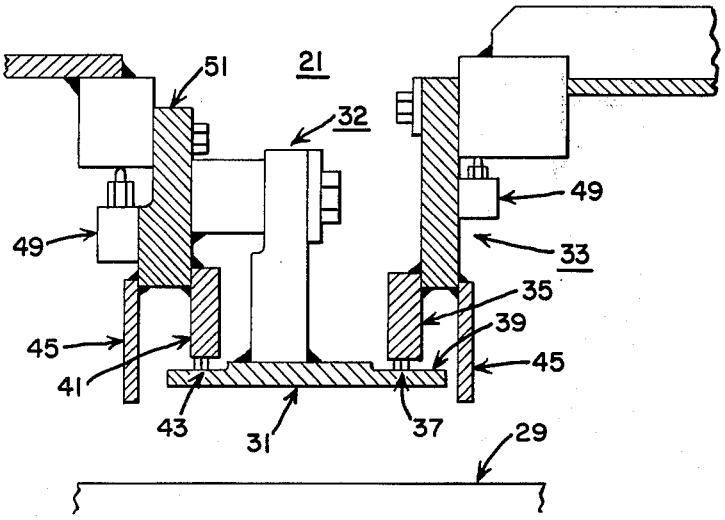
FIG. 3 is an enlarged cross section view of the present invention.

Referring to FIG. 3, the foregoing prior art problems are obviated by the construction of a seal means 21 which is located radially outwardly from the rotor surface 29 thereby eliminating the possibility of a packing rub. The present embodiment may be defined as a stationary to stationary seal since the seal is between the two adjacent sections rather than between a turbomachine section and the rotating rotor. Furthermore, the seal is based on an interference fit rather than a clearance fit as will be shown in the following description.

The sealing means 21 comprises an annular wrapper 31 which is positioned radially inward between two adjacent turbomachine sections but is radially outward from the rotor surface 29. The annular wrapper may, for example, have any convenient axial dimension. The annular wrapper is attached to one turbomachine section hood including annular support means 51 by support means 32 which may be a pair of circumferentially spaced supports located on each side of the casing horizontal joint. A radially inwardly extending annular sealing element 33 is attached to the other adjacent turbomachine section hood and includes an annular free end 35 which terminates in packing teeth 37, the free ends, of which, contact the outer surface 39 of annular wrapper 31 to form a sliding interference fit. An alternative to packing teeth may be an "O" ring. The sliding interference fit between the annular wrapper and the sealing element accommodates thermal movement between adjacent turbomachine sections.

The sealing means 21 may also include a second annular sealing element 41 which extends radially inwardly from the one turbomachine section end and terminates at the outer surface of the annular wrapper with packing teeth 43. Again, an "O" ring may be substituted for packing teeth. The annular wrapper 31 and the first and second sealing means may be axially included between a pair of annular oil deflectors 45 which extend radially inwardly toward the rotor surface but which are spaced therefrom. Adjustment means 49 are provided for aligning the annular wrapper and first sealing element.

The sealing means may be assembled between adjacent turbomachine section ends in the following manner. Support means 51 may be attached at one turbomachine section horizontal joint and have annular wrapper support means 32 attached thereto. Thereafter first annular sealing element 33 is attached to the other adjacent turbomachine horizontal joint and final alignment is made between the sealing means parts by means of adjustment means or leveling bolts 49.

While there is described what is considered, at present, to be the preferred embodiment of the invention, it is, of course, understood that various other modifications may be made therein. For example, the present invention may be applied between a turbine casing and a dynamoelectric machine. It is intended to claim all such modifications as fall within the true spirit and scope of the present invention.

What is claimed is:

1. In a turbomachine having at least two separate sections each section including a rotor portion; sealing means disposed between adjacent section ends and spaced radially outward from said rotor portion comprising:

a. an annular, axially elongated wrapper extending radially inwardly from one adjacent section end; and, b. a first sealing element attached at one end to the other adjacent section end, said sealing element extending radially inwardly toward said wrapper and having a free end terminating at the annular wrapper outer surface.

2. The sealing means recited in claim 1 further comprising a second sealing element attached at one end to the one adjacent section end, said sealing element extending radially inwardly toward said wrapper and having a free end terminating at the annular wrapper outer surface.

3. The sealing means recited in claim 2 wherein the first and second sealing elements are annular rings.

4. The sealing means recited in claim 2 wherein the annular wrapper extends axially between the first and second sealing elements.

5. The sealing means recited in claim 2 further comprising annular deflector means extending radially inwardly from each adjacent section end and each deflector means having a free end terminating adjacent the wrapper, said wrapper and the first and second sealing elements axially included therebetween.

6. The sealing means recited in claim 2 wherein each sealing element terminates in a plurality of sealing teeth.

7. The sealing means recited in claim 1 wherein there is an interference fit between the first sealing element and the wrapper.

8. The sealing means recited in claim 1 further comprising radial adjustment means for said annular wrapper and first sealing element.

9. An improved turbomachine of the type having at least two separate sections, each section including a rotor portion therein supported by a bearing element adjacent each section end, a sealing means disposed between adjacent section ends the improvement comprising:

a. an annular, axially elongated wrapper extending radially inwardly from one adjacent section end, said wrapper being spaced radially outwardly from said rotor portion;

b. a first sealing element attached at one end to the other adjacent section end, said sealing element extending radially inwardly toward said wrapper and having a free end terminating at the wrapper outer surface;

c. a second sealing element attached at one end to the one adjacent section end, said sealing element extending radially inwardly toward said wrapper and having a free end terminating at the annular wrapper outer surface; and, d. annular deflector means extending radially inwardly from each adjacent section end and each deflector means having a free end terminating adjacent the wrapper, said wrapper and said first and second sealing elements axially included therebetween.

* * * * *